United States Patent [19]

Taddei

[11] 4,253,837

[45] Mar. 3, 1981

[54] METHOD AND APPARATUS FOR APPLYING A METAL STRIP TO A SHEET MATERIAL

[75] Inventor: Carlo Taddei, Lugano, Switzerland

[73] Assignee: Seal Spout International, George Town, Grand Cayman, Cayman Islands

[21] Appl. No.: 6,207

[22] Filed: Jan. 24, 1979

[51] Int. Cl.[3] ..... B26B 1/90

[52] U.S. Cl. ..... 493/86; 156/92; 156/252; 156/513; 156/518; 225/49; 493/378

[58] Field of Search ..... 156/355, 513, 518, 520, 156/521, 556, 253, 92, 572, 252; 93/36 CE, 36 M, 36.9, 8 WA, 39 R, 41.1; 227/45, 47, 80, 82; 59/72, 77; 225/49

[56] References Cited

U.S. PATENT DOCUMENTS

| | | | |
|---|---|---|---|
| 1,843,429 | 2/1932 | Marcalus | 93/8 WA |
| 2,066,475 | 1/1937 | Kramig et al. | 156/92 |
| 2,285,447 | 6/1942 | Lichter | 156/521 |
| 2,332,644 | 10/1943 | Junkin | 93/41.1 |
| 3,088,381 | 5/1963 | Paist et al. | 93/41.1 |
| 3,108,726 | 10/1963 | Hawk | 225/49 |
| 3,654,038 | 4/1972 | Hottendorf | 156/521 |
| 3,713,948 | 1/1973 | Kluger | 156/521 X |
| 3,819,448 | 6/1974 | Beever | 156/355 |
| 3,915,785 | 10/1975 | Muller | 156/521 X |
| 3,986,440 | 10/1976 | MacDonald et al. | 93/36 M |
| 3,992,981 | 11/1976 | Stock | 156/515 X |

*Primary Examiner*—Michael G. Wityshyn
*Attorney, Agent, or Firm*—Diller, Ramik & Wight

[57] ABSTRACT

A machine is disclosed which is intended to apply a saw-toothed blade to containers (for example of cardboard) which hold a coil or roller of aluminum foil or plastics material film of the kind used, for example in the kitchen or household in general. The saw-toothed blade must slightly protrude from the bottom front edge of the container to enable the user to tear out the portion of foil or plastics sheet to be used from time to time. The machine comprises a station in which the saw strips are severed from a metal tape and are applied to the flattened container, the latter being conveyed to the station by a conveyor belt assembly. The machine is equipped with appropriate cam and lever controlling and synchronizing means to have all the operative steps performed in the correct sequential order: the machine is compact and easily inspectable by one operator and the feeding means are all located on the longitudinal central axis of the machine. The station at which the metal strips are severed and applied to the cardboard sheets is placed nearly midway between the points at which the metal tape and the cardboard pieces are fed, these two materials being fed into the machine from opposite directions, that is, in counterflow relationship.

43 Claims, 15 Drawing Figures

Fig. 2
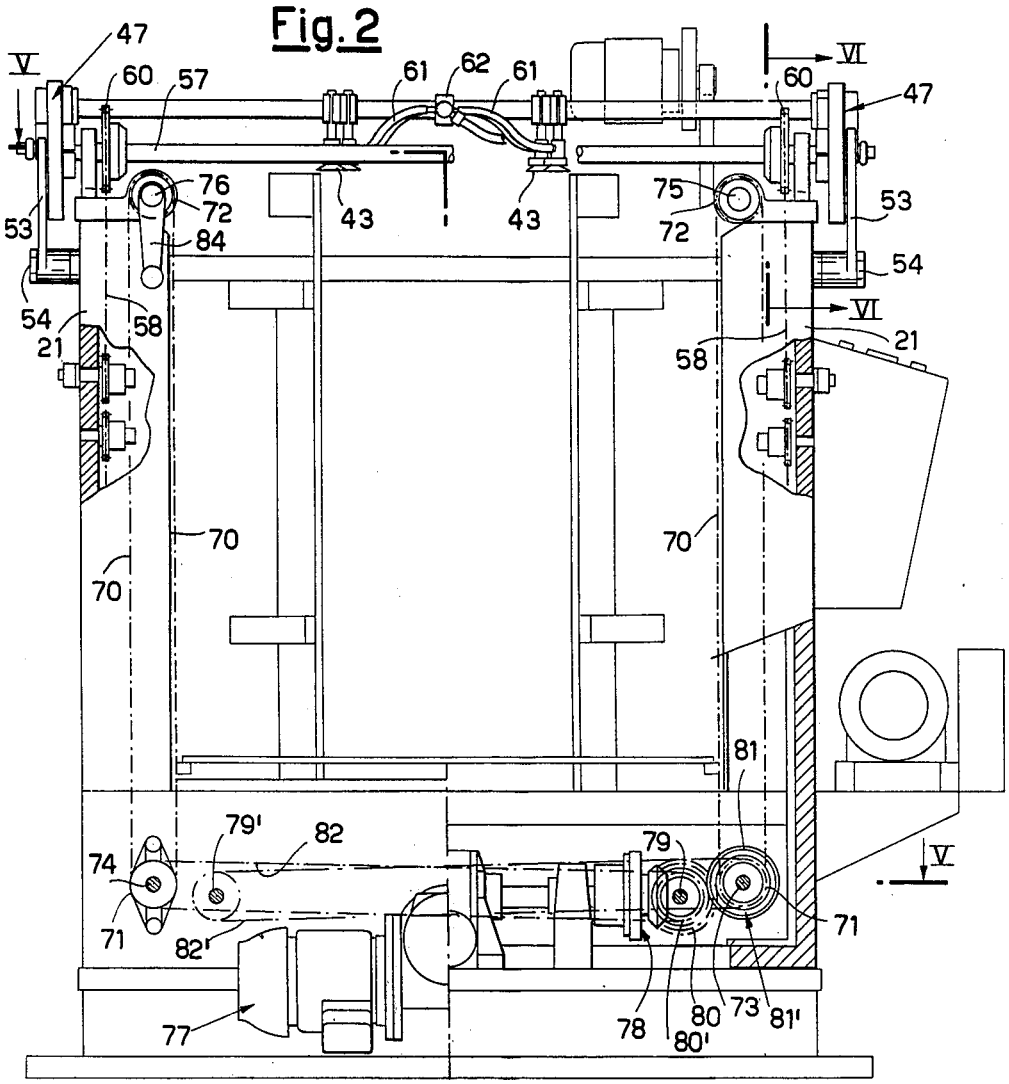
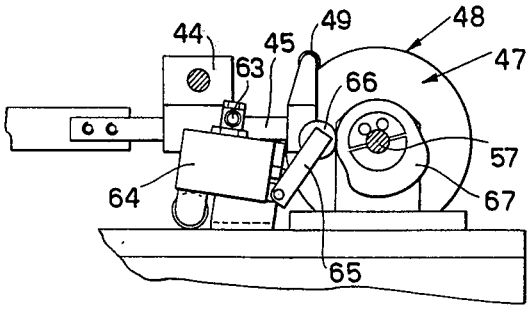
Fig. 6

XIV
160
161
162
162
163
164
156
164
169
170
42
42
21
21
165
135'
166
39
169
170
167
165
166
39
135
169
167
XIV

METHOD AND APPARATUS FOR APPLYING A METAL STRIP TO A SHEET MATERIAL

This invention relates generally to a machine for applying automatically a metal strip to a sheet material.

More particularly, the invention applies to the field of the automatic application of a blade having a saw-like edge, to a sheet material unit which is the development of a plane of a container intended to house aluminum foil or plastic material sheet rolls, substantially for household and food wrapping use.

The toothed blade is applied on the development on a plane in such a position that, as the container is in its final shape, it juts from the container edge in correspondence with the side of the container from which the foil or film emerges as it is drawn from the roll and withdrawn from the container by manually pulling it therefrom, and is severed from such roller by tearing it against the saw blade.

To provide a machine for automatically applying such saw blades involves the solution of several technical problems which are other than simple.

For such a machine to be economically acceptable, it must have, at the outset, a very high working speed, in the order of magnitude of more than 100 blades applied in a minute. Such a feature of a very high working speed, as it is apparent, conflicts with the fact that the blade must be applied on the development on a plane of the container at a precisely preselected point, in order that its saw-toothed profile may properly protrude out of the edge of the container when the latter is assembled, in correspondence with the side from which the film to be severed emerges. Thus, means must be provided which are capable of pre-positioning both the development on a plane of the container and the blade in a position, the one with respect to the other, which is determined with a high accuracy so as to have the blade applied to the flattened container surface in the desired correct position.

Another technical problem which is not easy to be solved, is that related with the discharge from the machine of the flattened container surface with the blade applied thereto in such a way as not to interefere with the subsequent cycle of applying the blade to the next flattened container and so on.

An object of this invention is, more particularly, to solve the technical problems outlined above and others which will become apparent hereinafter by providing a machine capable of working with a high accuracy at very high operational speeds, and having in addition a very compact layout.

Having these objects in view, according to the invention, it has been envisaged to provide a machine for applying a metal strip to a sheet material unit, said machine being characterized in that it comprises, in combination:

(a) A shaping station for said metal strip and for applying same to said sheet material units;

(b) A feeding unit for feeding said sheet material units to said shaping station;

(c) A feed source for feeding a metal tape to the shaping station in superposed relationship relative to said sheet material unit;

(d) In said shaping station, shaping and applying means adapted to sever said strip from said metal tape and to apply it to said sheet material unit, and (e) First conveyance means adapted to convey the sheet material unit with the metal strip applied thereto by said shaping station, to the exterior of the machine;

(f) actuation and control means being further provided, which are adapted to control the machine in the correct operational sequence.

The feeding unit and the feeding source are all situated on the same longitudinal central axis of the machine.

More exactly, said station is in a position which is intermediate with respect to said feeding unit and said feeding source, so that the units of sheet material and the metal tape are fed to the station from opposite directions, that is, in counterflow relationship with respect to one another.

The structural and functional features of the invention, and its objects and advantages as well will become still more appreciable from a scrutiny of the ensuing description, aided by the accompanying drawings wherein:

FIGS. 1*a* and *b*, when assembled side by side, show a side elevational view of the machine according to the invention.

FIG. 2 is a side elevational view taken along the direction of the arrow F of FIG. 1*a*, some parts being in cross-section.

FIG. 6 is a cross-sectional view taken along the line VI—VI of FIG. 2.

The machine in question has been generally indicated by the reference 20 and has a substantially parallelelpipedal casing 21 which contains all the working component parts of the machine.

Figure 4:
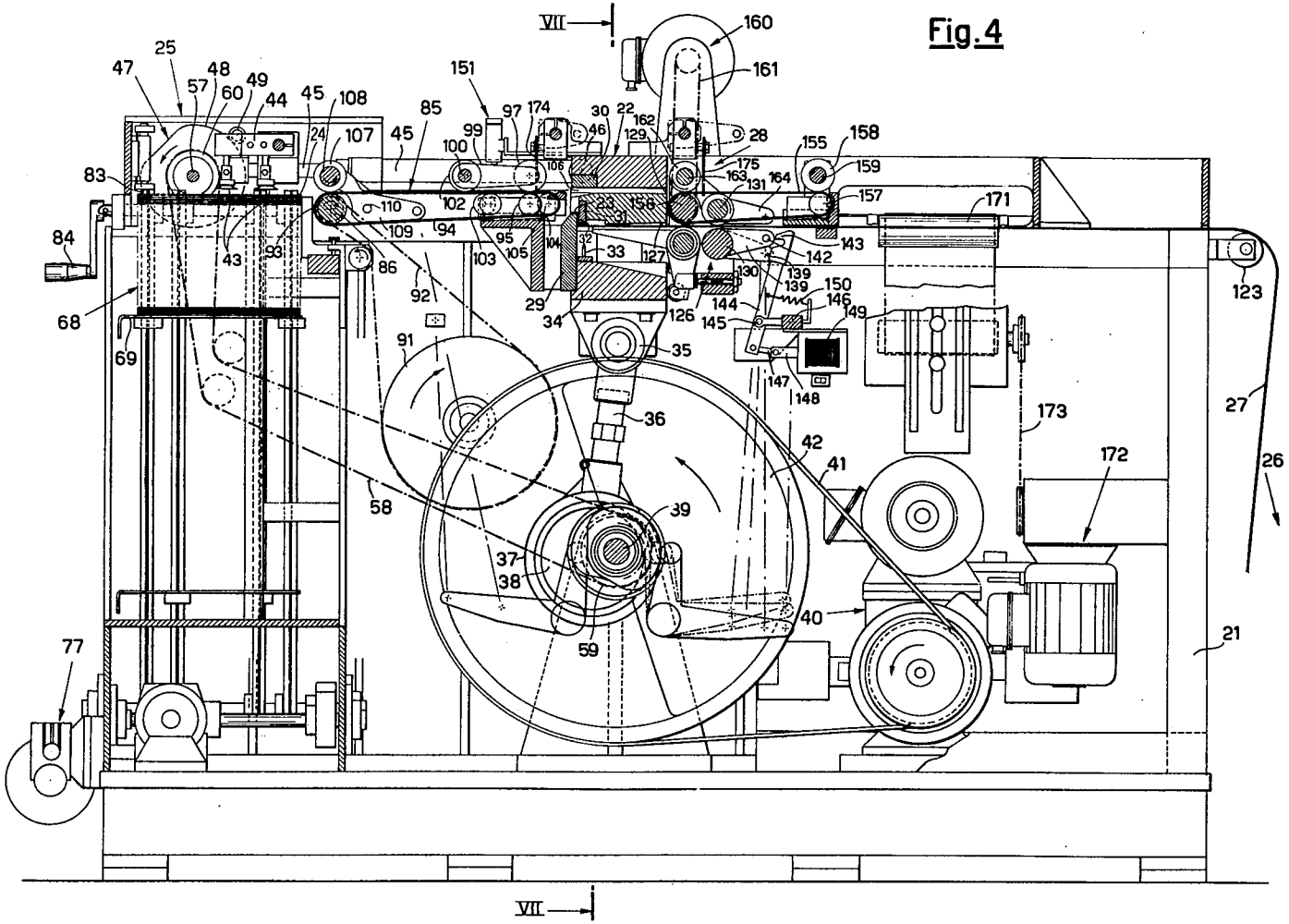
FIG. 4 is a cross-sectional view taken along the line IV—IV of FIG. 3.
Figure 5:
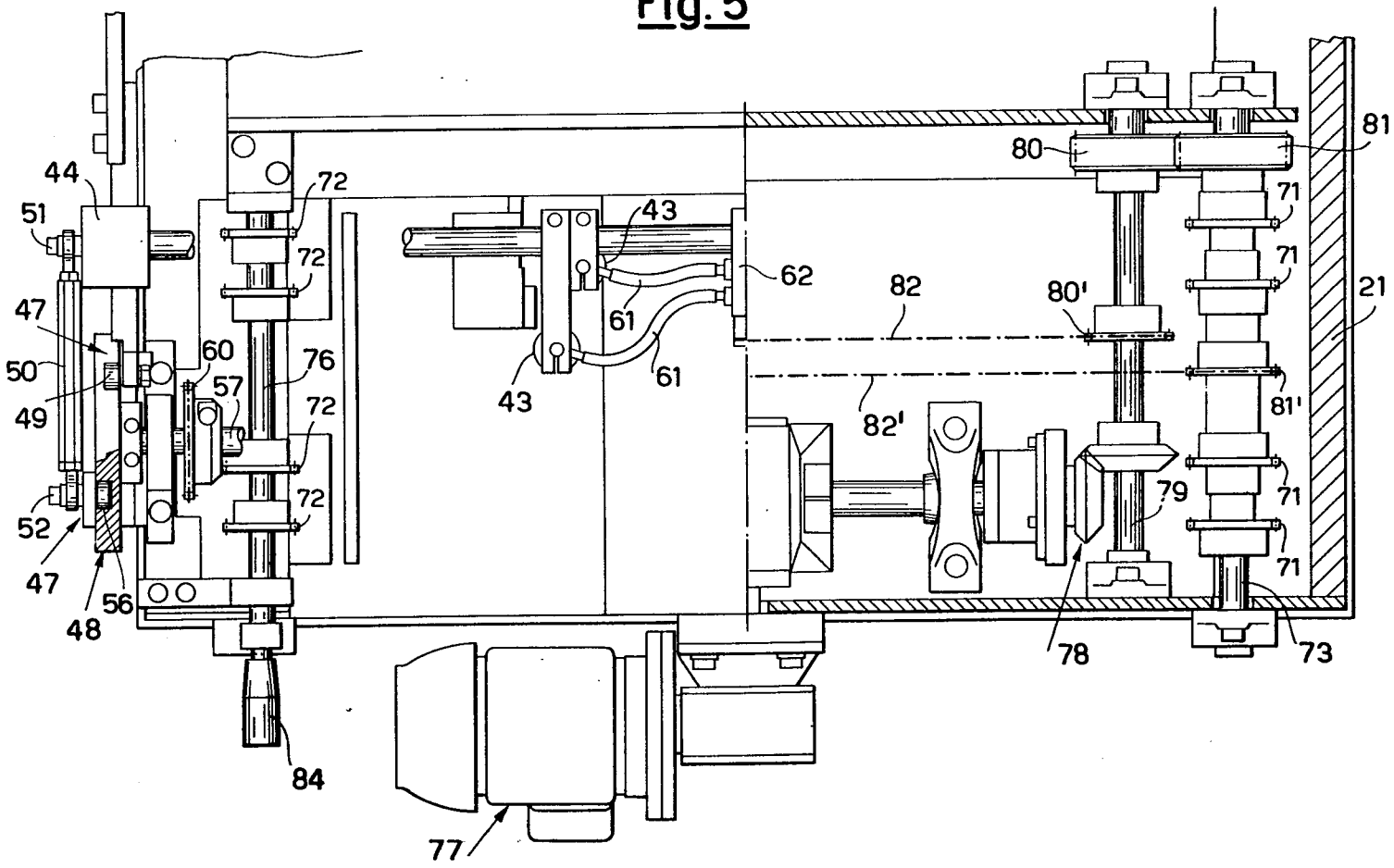
FIG. 5 is a cross-sectional view taken along the line V—V of FIG. 2.

Having particular reference to FIG. 4, the machine is structurally composed, as to its essential units, by an intermediate station 22 for shaping the saw-toothed metal strip 23 and for applying same to a sheet-material unit 24 (for example the flattened out surface of a container intended to contain rolls of aluminum foil or plastics material film), a unit 25 for feeding the sheet-material unit 24 to the station 22, a source 26 for feeding a metal tape 27 to said station 22 in superposed relationship with the unit of sheet material 24, and first conveyance means 28 which are capable of conveying the sheet-material unit 24 with the strip 23 applied thereto, from the station 22 to the exterior of the machine.

Figure 7:
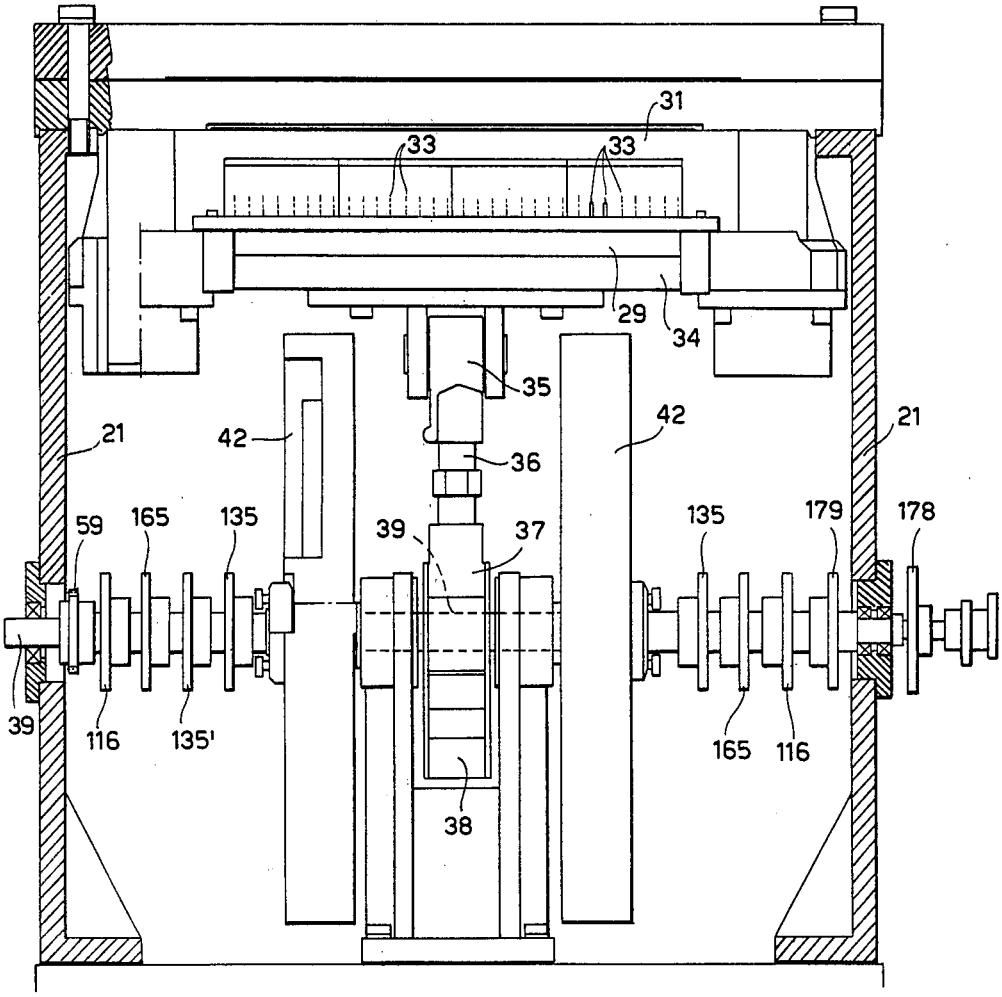
FIG. 7 is a cross-sectional view taken along the line VII—VII of FIGS. 3 and 4.
Figure 8:
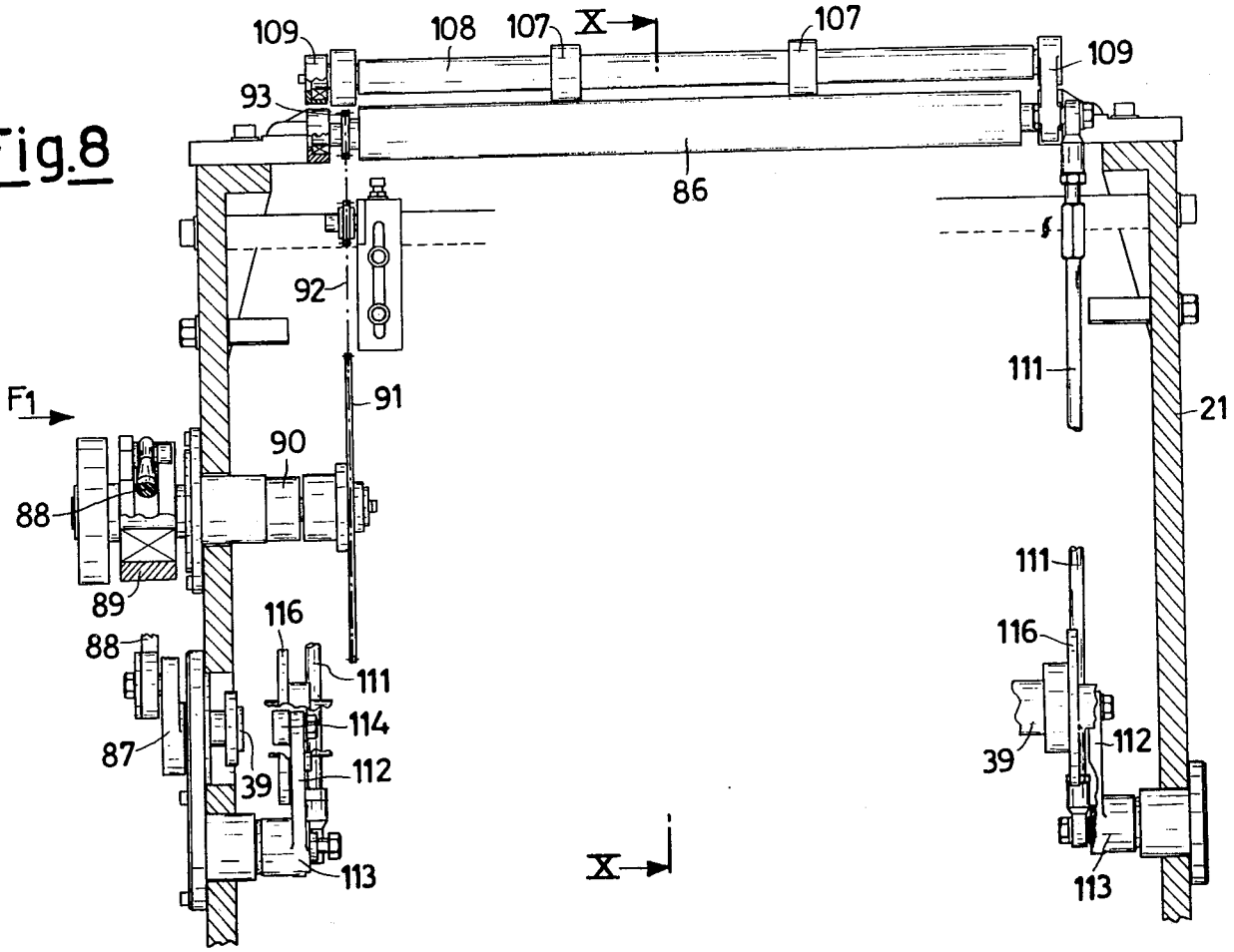
FIG. 8 is a cross-sectional closeup view taken along the line VIII—VIII of FIG. 3, some parts having been removed to make the showing clearer.
Figure 9:
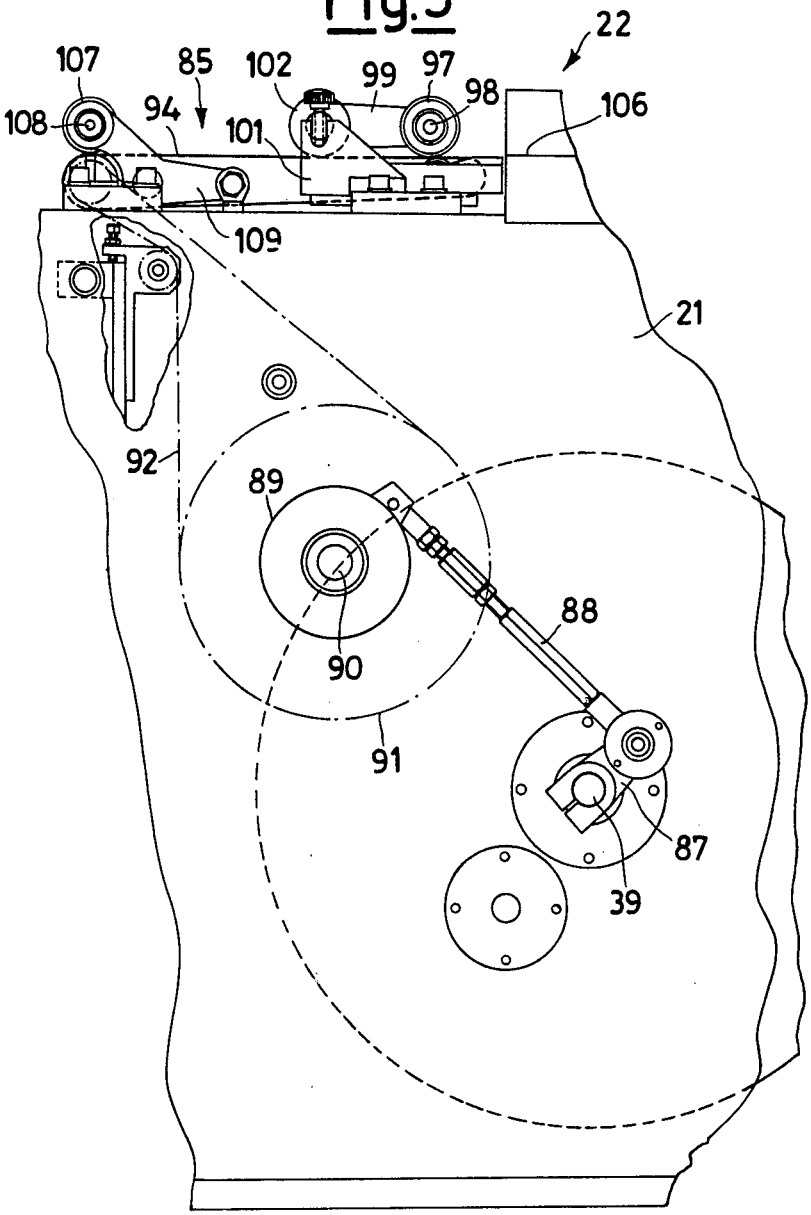
FIG. 9 is an elevational view taken along the direction of the arrow $F_1$ of FIG. 8.
Figure 10:
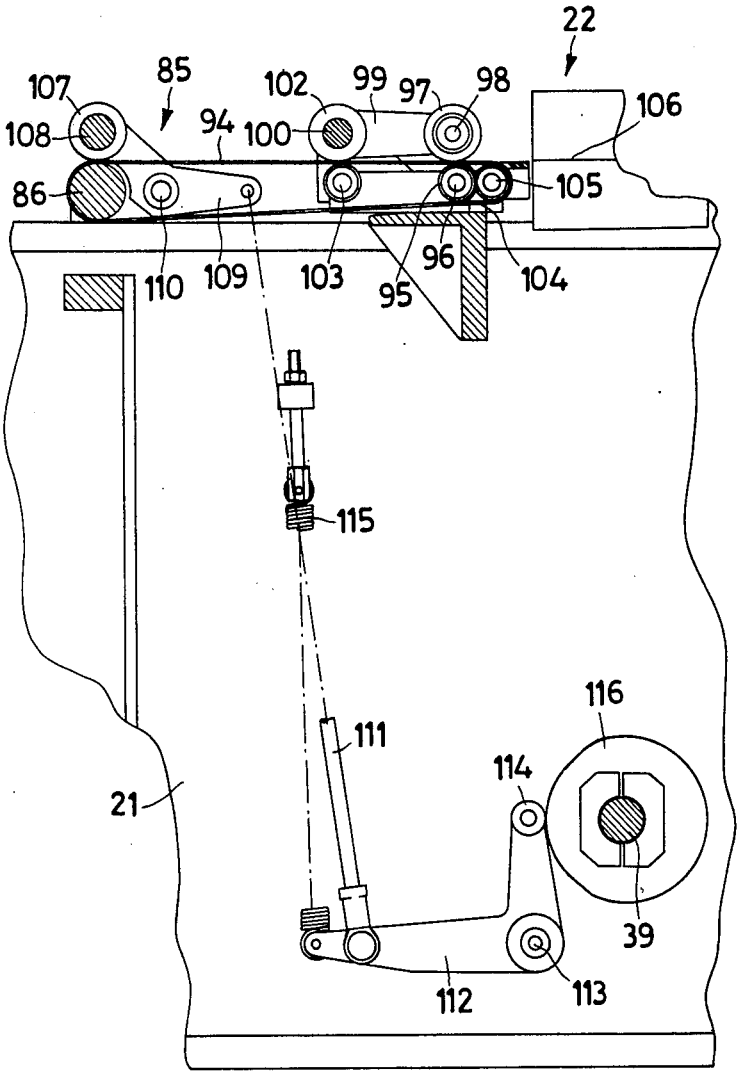
FIG. 10 is a cross-sectional view taken along the line X—X of FIG. 8.
Figure 11:
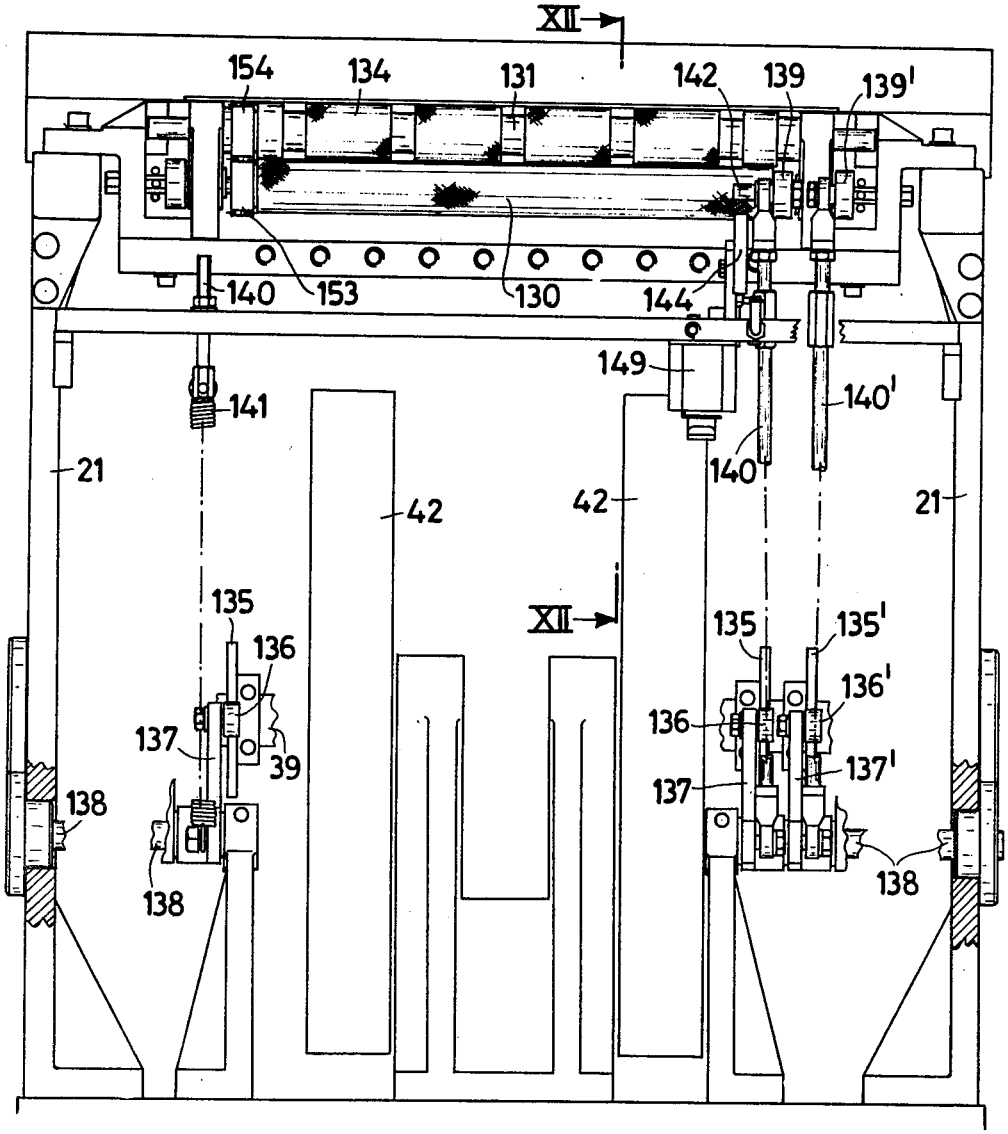
FIG. 11 is a cross-sectional view taken along the line XI—XI of FIGS. 3 and 12.
Figure 12:
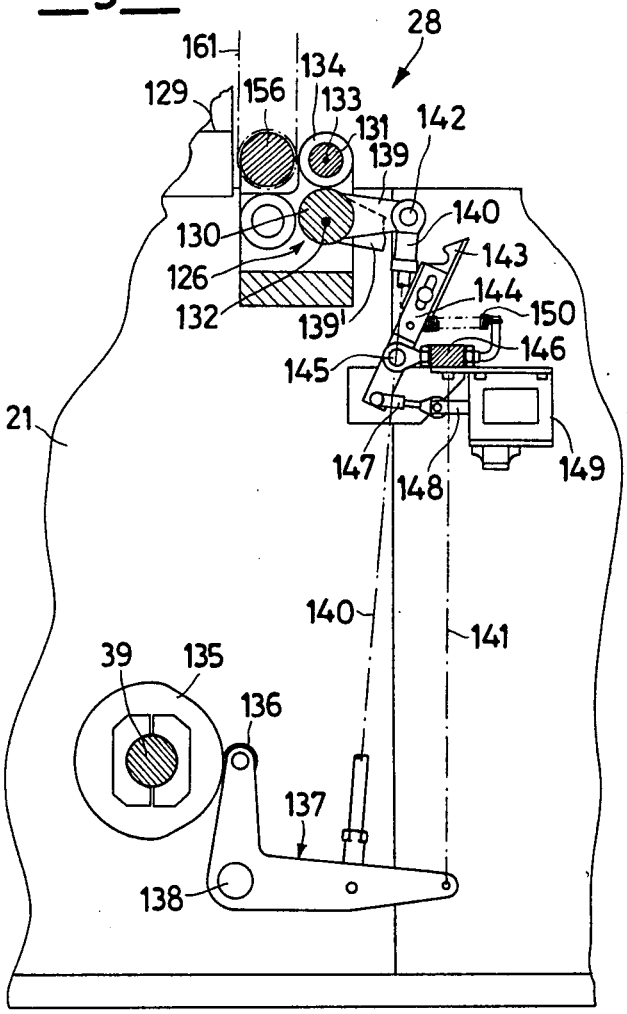
FIG. 12 is a cross-sectional view taken along the line XII—XII of FIG. 11.
Figure 13:
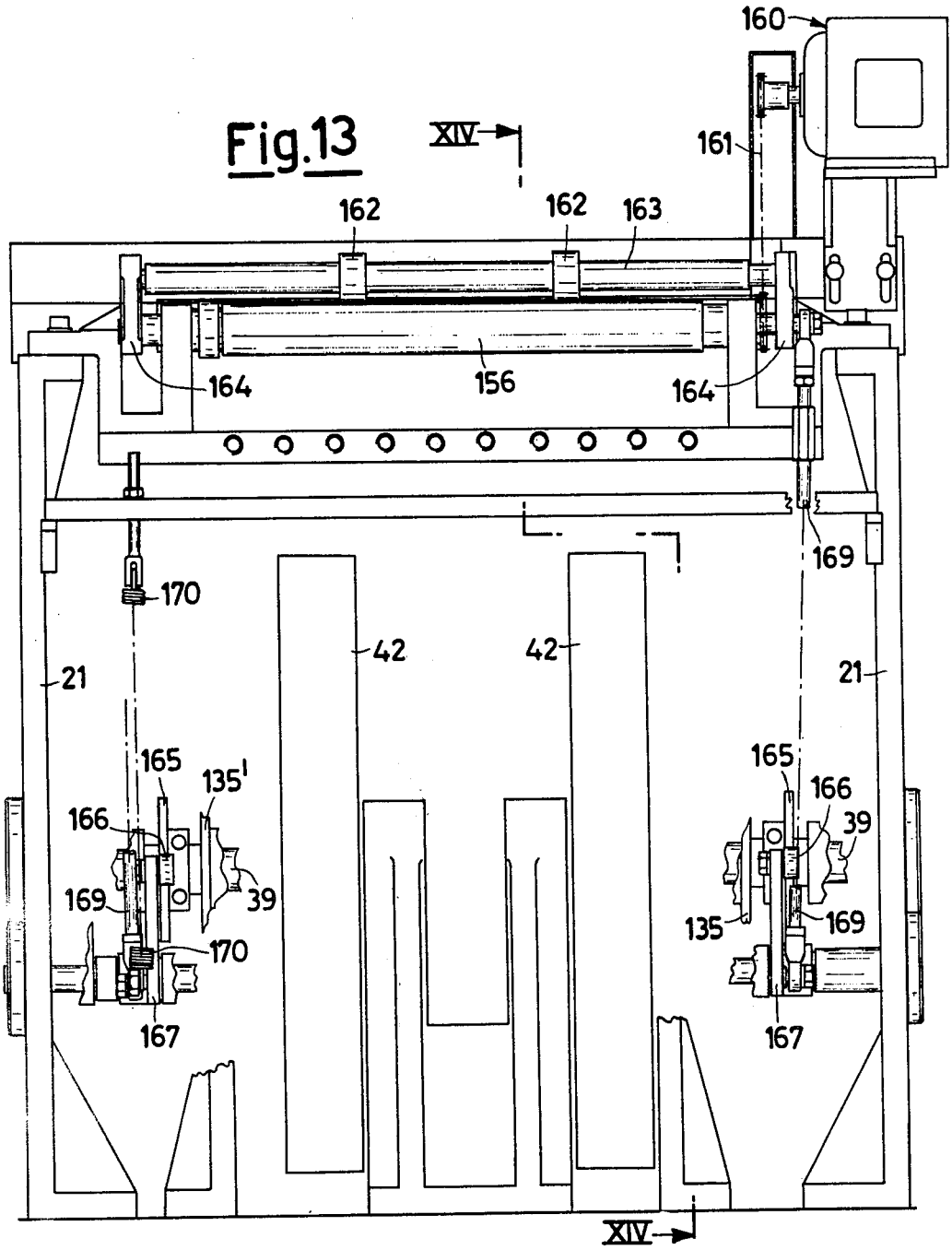
FIG. 13 is a cross-sectional view taken along the line XIII—XIII of FIGS. 3 and 14.
Figure 14:
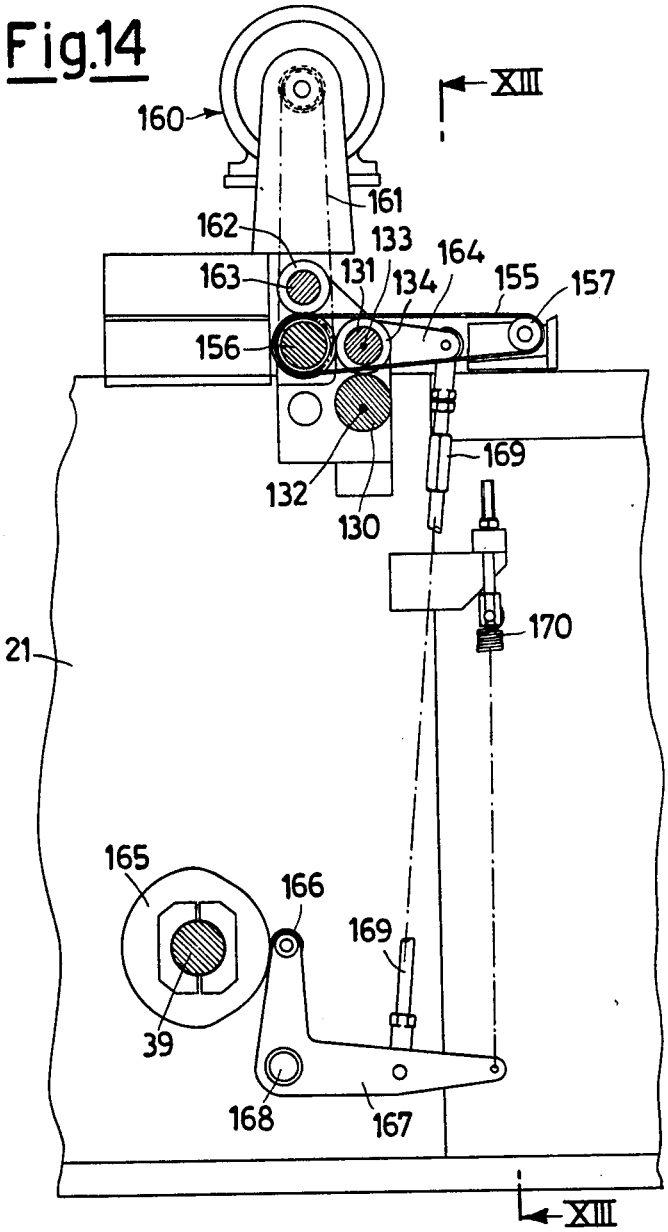
FIG. 14 is a cross-sectional view taken along the line XIV—XIV of FIG. 13.

The station 22 (FIGS. 4 and 7) comprises a movable die 29, cooperating with an anvil 30 and a fixed die 31 having a set of counter punches 32 which cooperate with respective punches 33 borne by the supporting member 34 itself of the movable die 29.

The supporting member 34 of the movable die 29 is pivoted to the pin of a crank 38 keyed to a rotary shaft 39, which, as will be seen hereinafter, is the machine mainshaft. The shaft 39 is driven by a reducing gear unit 40 via belts 41 which are connected to either of the two flywheels 42.

The assembly 25 (FIGS. 1*a*, 1*b*, 2, 3, 4, 5 and 6) for feeding the sheet material units 24 to the station 22 comprises a plurality of suction cups 43 for grasping the sheets 24, the cups being borne by a slider 44 which is driven to effect a to-and-fro motion on a couple of side guideways 45: these are mounted oscillably about 46. The reciprocation of slider 44 along the guideways 45 is brought about by a couple of lateral cams 47: each cam has an active profile 48 acting upon a cam follower 49 which is mounted on the slider 44. The swinging motion of the guideways 45, thus of the slider 44, about 46, is brought about, conversely, by a desmodromic assembly which comprises a connecting rod 50 pivoted at 51 to the slider 44 and at 52 to either end of a lever 53; the opposite end of 53 is pivoted, at 54, to a sidewall of the machine body 21. The lever 53, at a midway point of it adjacent to 52, carries an idle follower 55 which is confined within a guideway 56: such guideway 56 is formed on the external surface of the cam 47. The cams such a 47 are mounted rotatably about a shaft 57 and their rotation is controlled by the driven shaft 39 via the respective chain drives 58 and pinions 59 and 60.

Each suction cup 43 is connected, via a respective hose 61 to a manifold 62 which, in its turn, is connected via a hole 63 to a valve 64 for controlling the intermittent evacuation of the suction cup 43, such evacuation being effected by means of an appropriate vacuum source (not shown). To this end, the control lever 65 of the valve 64 carries an idle cam follower 66 upon which a cam 67 keyed to the shaft 57 is active: cam 67 is keyed to shaft 57 near one of the cams 47 aforementioned.

The first sheet-material unit 24 of sheet stack 68 is brought adjacently to the cups 43 by an elevator mechanism comprising a tray 69 fastened to a set of vertical side chains 70 which are driven to run in a closed loop about respective couples of pinions 71, 72, respectively, in the bottom and top locations. The bottom pinions 71, on the right and left side of the machine as viewed in the drawings, are keyed to the respective shafts 73, 74. Likewise, the top pinions 72 are keyed to shafts 75, 76, respectively.

The correct run of the chains 79 and thus the elevation of the try 69 are controlled by a driver and reducing gear unit 77 via a bevel gear 78 and a shaft 79, the latter being operatively connected to 73 by a gear train 80, 81, and to 74 by a chain drive 82.

Likewise, the shaft 74 is connected via a gear train 80', 81', to a shaft 79: the latter, in its turn, is connected via a chain drive 82' to the shaft 73. Thus the desired directions of run are obtained by the agency of a reliable mechanical connection.

The actuation of the drive and reducing gear 77 is controlled by a sensing means 83 which is capable of sensing the presence of a sheet 24. The tray 69, moreover, can be shifted manually by means of a crank 84 fastened to the shaft 76.

Between the suction cups 43 and the station 22, a unit 85 is provided, which is capable of feeding the sheets 24 in quick succession to the station 22 (FIGS. 4, 8, 9 and 10).

Unit 85 comprises a shaft 86 which is rotated by the driven shaft 39 via a crank 87, a connecting rod 88, a unidirectional clutch 89. The output shaft 90 of 89 carries a pinion which is connected by a chain 92 to a gear 93 keyed to the shaft 86. It is apparent that the unidirectional clutch 89, which may be of any conventional make, converts the continuous rotation of the shaft 39 into an intermittent rotary motion of the shaft 86.

The shaft 86 is connected via a couple of central belts 94 to a couple of rollers 95 idly mounted on 96. The rollers 95 are urged by respective rollers 97 which are idly mounted at 98 to the free end of a relative arm 99, the latter being oscillable on the shaft 100: this shaft is mounted stationary on side bearings 101. In addition, shaft 100 carries, adjacent to the arms 98, idle rollers 102 which urge the belts 94 against idle rollers 103 therebeneath.

In addition, the shaft 86 is connected by couples of lateral belts 104, to respective idle rollers 105 which are adapted to carry the sheets 24 into the relative mouth 106 of station 22.

The shaft 86 cooperates, in addition, with a set of pressure rollers 107 slipped onto a shaft 108, the latter being idly borne by a couple of lateral bell-crank levers 109. The bell-crank levers 109 are pivoted, each, at 110 oscillably to the machine body and their swinging motion is brought about, via a clevis 111, by a respective bell-crank lever 112. Lever 112, in its turn, is pivoted oscillably at 113 to the machine casing. Each lever as 112 carries an idle cam follower 114 which is biassed constantly by a spring 115 into operative contact with a respective cam 116 keyed to the mainshaft 39.

Such a roller and belt assembly ensures a correct conveyance of the sheets 24 from 25 to 22, in the manner which will be explained hereinafter.

Figure 1A:
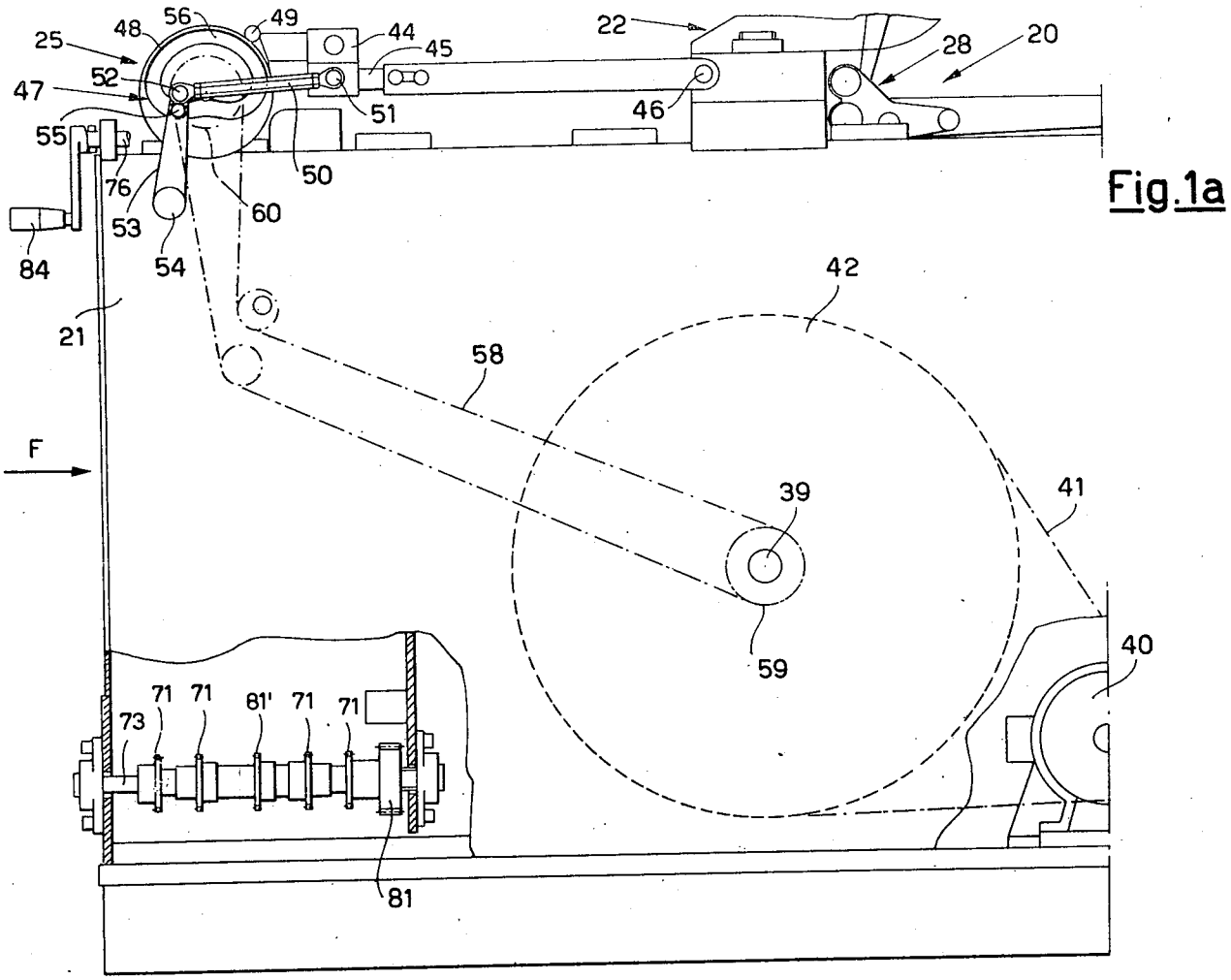
Figure 1B:
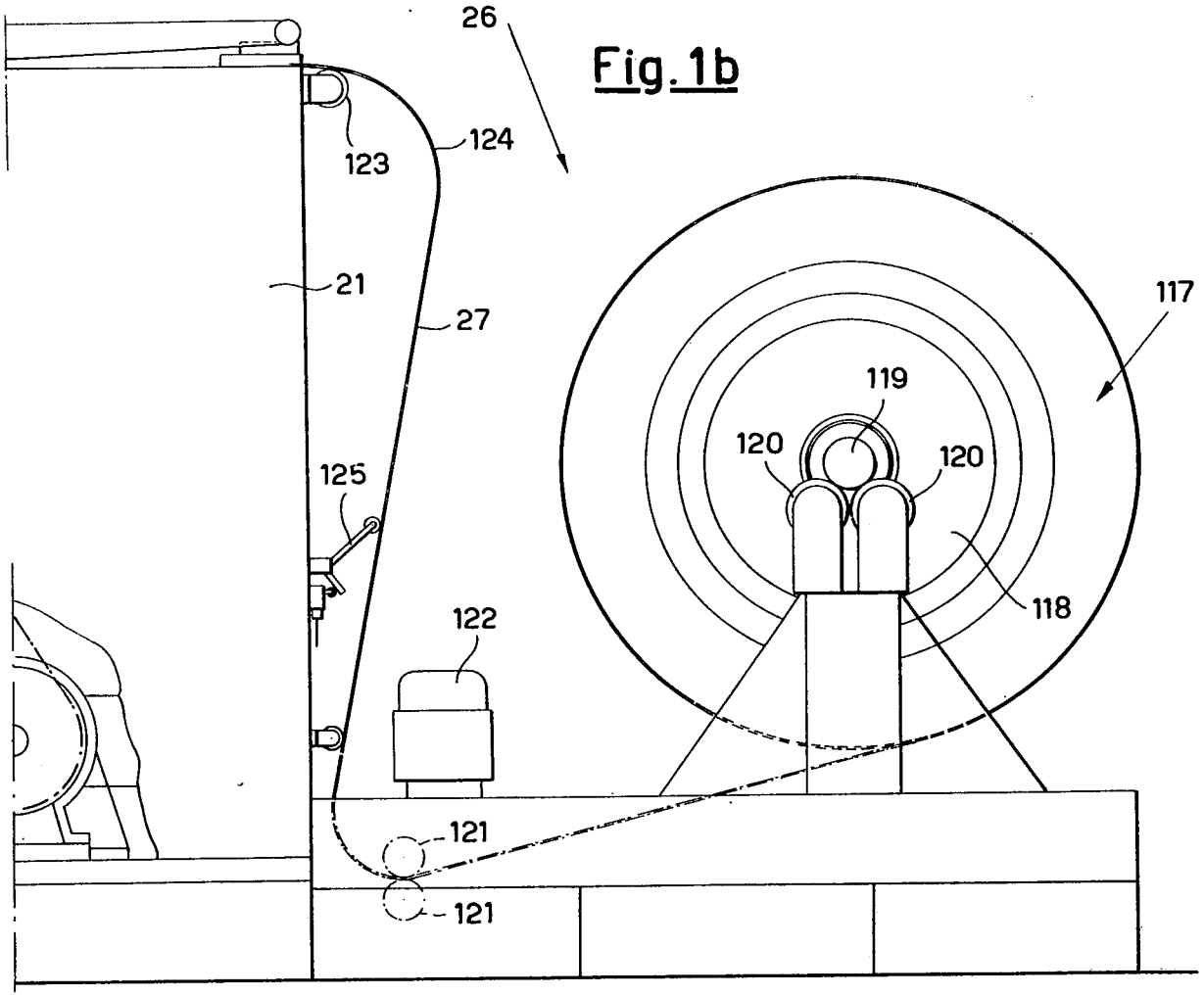
Figure 3:
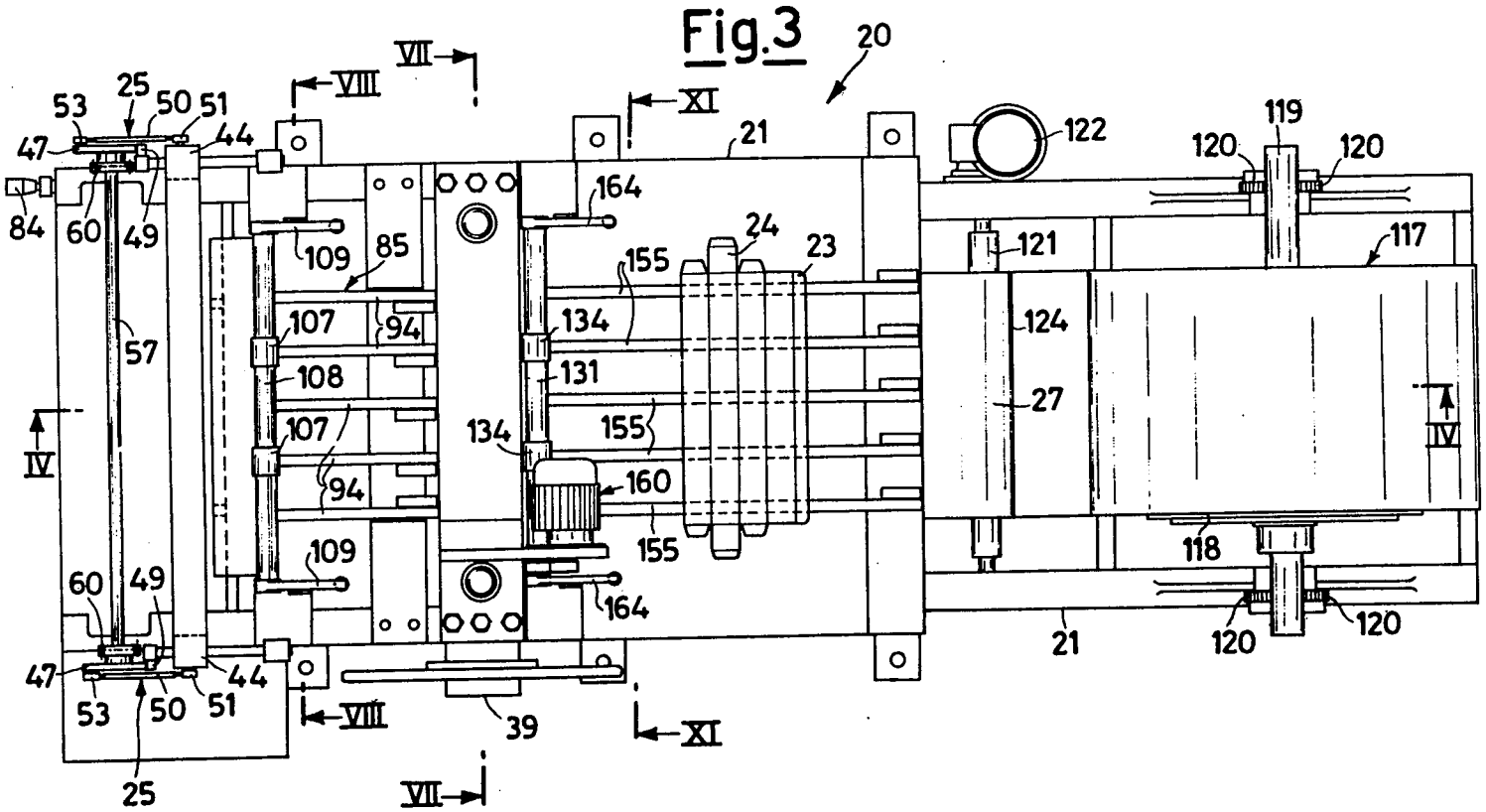
FIG. 3 is a plan view of the machine of FIGS. 1*a* and 1*b*.

With refernce to FIG. 1*b*, the source 26 of feed of the metal tape 27 to the station 22 comprises a coil 117 of metal tape wound on a core 118 the shaft 119 of which freely rests on couples of lateral bearings of the rolling type, 120. The tape 27 is paid off by the pull applied thereto via a couple of cylinders 121 one of which is driven by a drive and reducing unit 122.

Downstream of the cylinders 121, the tape 27, prior to being guided into the machine by a delivery rollers 123, forms a bend 124 the creep of which is sensed by a sensor 125: sensor 125 gives a concent to the start of the drive and reducing gear 122 only when the bend 124 has reached a certain preselected minimum curvature. The bend 124 is a storage member for the intermittent feed of the tape 27 to the station 22. Such an intermittent feed is brought about by a feeding unit 126 which is arranged in correspondence with the mouth 127 of station 22, through which the tape 27 is introduced, and beneath the conveyance means 28 which is placed in correspondence with the outlet 129 through which the sheet 24 with its strip 23 applied thereto exits the machine.

More detailedly (FIGS. 4, 11, 12, 13 and 14), the unit 126 comprises a couple of shafts 130–131, bottom and top shaft, respectively, which are rotated about their own axles 132, 133, of which 132 is eccentrical for a reason to be clarified hereinafter. The bottom shaft 130 has its surface completely knurled so as to cooperate with a set of sleeves 134, likewise knurled, formed integrally on the surface of the top shaft 131.

The shaft 130 is driven oscillably and intermittently reciprocably about the eccentric axle 132 and the anticlockwise swing is driven by a couple of cams 135 which are keyed to the main shaft 39. As a matter of fact each cam 135 acts on an idle cam follower 136 of a bell-crank-lever 137, the latter being pivoted at 138 to the machine casing and connected to side arms 139 which are integral with the shaft 130, by the agency of a clevis 140. A spring 141 constantly urges the follower 136 into operative contact with the cam 135. From either arm 139 depends a pin 142 which is adapted to become hooked by the hook 143 of a lever 144. Lever 144 is pivoted at 145 to a fixed supporting member 146. The lever 144 is linkably connected by a pitman 147 to the core of an electromagnet 149, and a spring 150 keeps the lever 144 in the position shown in FIG. 4.

It is to be noted that the disengagement of the hook 143 from the pin 142 is controlled by a sensor of the presence of a sheet such as 24 at the mouth 106 of the station 22. In the example shown herein such sensor is a rocker 151 pivoted oscillably on a stationary arbor (unnumbered) and acts upon a microswitch (unnumbered): the latter controls the action of the electromagnet 149.

The shafts 130 and 131 are mutually operatively connected by a couple of respective gears 153, 154, so as to bring about a positive feed of the metal tape 27.

The clockwise swing of the shaft 130 is controlled, conversely, by a single cam 135' fastened to the shaft 39. Cam 135' acts upon an idle cam follower 136' of a bell-crank lever 137' which is also pivoted, at 138, to the machine casing and is connected to a side arm 139': the latter is fastened to the shaft 130 with an angular shift relative to 139 by means of a clevis 140'. A spring (unnumbered) maintains the follower 136' in constant operative contact with the cam 135'.

Having now reference to FIGS. 3, 4, 11, 12, 13 and 14, the conveyance means for the sheets 24, having the saws 23 applied thereto, placed at the exit 129 of the station 22 comprise a conveyor with belts 155 which are held taut in closed loop between a driven shaft 156 and respective idle rollers 157 which are pressed by respective pressure rollers 158 idly borne by a stationary shaft 159. The shaft 156 is driven by an electric motor 160 via a chain drive 161. The shaft 156 cooperates with a couple of pressure rollers 162 which are keyed to an idle shaft 163, the latter shaft being oscillably supported by a couple of bell-crank levers 164 mounted laterally. The levers 164 are pivoted for oscillation about the same axis 133 of the shaft 131 and their rocking motion is controlled by respective cams 165 which are keyed to the mainshaft 39. Each cam 165 acts upon a cam follower 168 carried by a bell-crank lever 167. Lever 167 is pivoted at 168 to the machine casing. A clevis 169 connects each lever 167 to the respective lever 164 and a spring 170 constantly urges the follower 166 into operative contact with the cam 165.

The rollers 162 can thus be brought into operative contact with the shaft 156 and be withdrawn therefrom.

Downstream of the conveyance means 28 aforesaid, there is provided, in addition, a conveyor belt 171 driven by an electric motor 172 via a chain drive 173, so as to run in a closed loop in a direction which is perpendicular to the longitudinal central axis of the machine.

By so doing, the sheets 24 coming from 28 freely fall onto the belt 171 and are dumped laterally of the machine.

Figure 15:
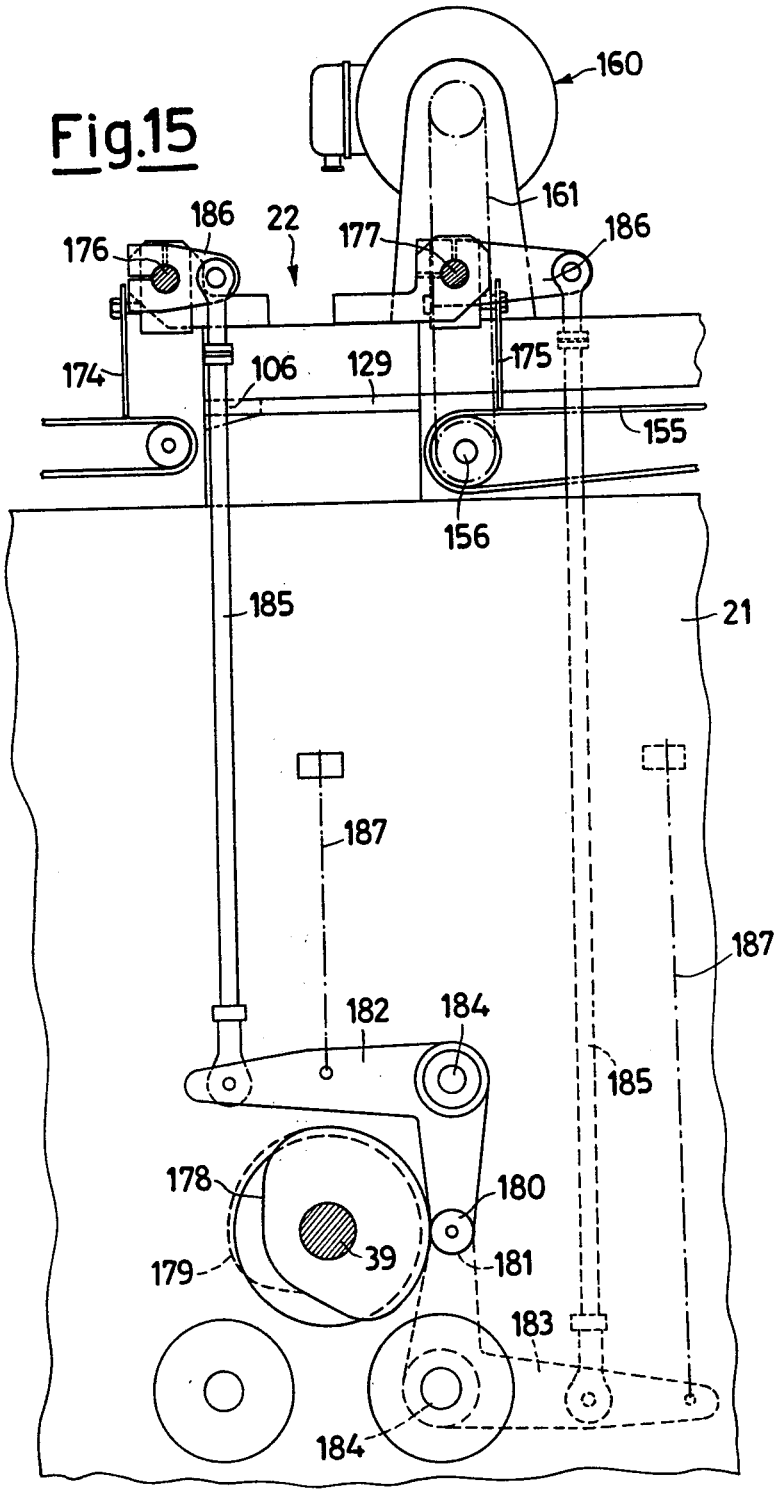
FIG. 15 is a detail elevational view.

Positioning means are furthermore provided, which are adapted to position each sheet 24 correctly in station 22. Such positioning means (FIGS. 4 and 15) comprise two couples of flaps 174, 175 mounted oscillably in correspondence of the intake 106 and the outlet 129, respectively, of the station 22.

The flaps 174, 175 are fastened to their respective shafts 176, 177 and these latter are driven oscillably about their axis by relative cams 178, 179 keyed to the mainshaft 39.

The cams 178, 179 cooperate with the respective cam followers 180, 181 mounted on bell-crank movers 182, 183. Each lever such as 182, 183 is mounted oscillably at 184 and pivotally relative to the machine body; by a clevis 185, the lever such as 182, 183, is connected to a radial arm 186 which is integral with its respective shaft 176, 177. A spring 187 keeps the relevant follower in operative contact with its respective cam 178, 179.

The machine described in the foregoing operates as follows.

The mainshaft 39 is driven to anticlockwise rotation so that the suction cups 43, through the cam 47 and the desmodromic system described above, are pushed down and oscillate about 46 so as to draw the first sheet 24 of the stack and are pushed (towards the right as viewed in FIG. 4) along the side guideways 45, in order to insert the sheet 24 as drawn between the shaft 86 and the rollers 107 which are now at standstill and spaced apart from one another. As soon as a portion of the sheet 24 lies between 86 and 107, these members are pushed down by the cams 116, via 112, 111 and 109, whereafter the shaft 86 is actuated so as to be quickly rotated through one step, through 39, 87, 88, 89, 90, 91, 92 and 93. As a result, the sheet 24 is urged by the belts 94 and 104 to enter station 22 through the mouth 106 thereof. At station 22 the sheet 24 is stopped in its stroke against the lowered flaps 175, since the shaft 156 and the rollers 162 set apart from each other. At this stage, the downstream flaps 174, which had been lifted beforehand, of course, are lowered against the trailing edge of the sheet 24 which thus becomes stably and accurately positioned in station 22, between 174 and 175. The depressional motion of the flags 174 takes place via 39, 178, 182, 185 and 186, and 176.

Meanwhile, the run of the sheet 24 has caused, via the rocker 151, the energization of the microswitch 152 and this deenergizes the electromagnet 149, so as to bring about the unhooking of 143 from 142. At this stage the eccentrical shaft 130 is driven so as to oscillate through one step anti-clockwise through 39, 135, 137 and 139.

The result is that the tape 27 is pinched between 130 and 134 and caused to go ahead through one step, so that its leading edge is positioned exactly between the dies 29 and 31 in order that a strip 23 may be severed therefrom and applied to the sheet 24 by the movement of the movable die 29 which is brought against the anvil 30. At this stage, it is to be noted that during this movement the punches 33, in unison with the counter-punches 32 form on the tape 27 the staples for the application to the next sheet 24 of the strip 23 to be severed during the next operative cycle. During the lifting stroke of the movable die 29 the strip 23 will be held in position on such die by suction means, retractable dowels or any other equivalent means.

Once a strip such as 23 has been applied to the sheet 24, the latter is set clear of the flaps 174–175 which are lifted, while the rollers 162 are lowered against the driven shaft 156 by the agency of 39, 165, 167, 169 and 164. The sheet 24 is then conveyed by the belts 155 to fall onto the conveyor belt 171 which sends the sheet laterally of the machine, for example to drop into a collection bin. Meanwhile, a fresh sheet 24 and the free edge of the metal tape are already preset in the station 22 during progress of a subsequent operative cycle.

In this latter connection, it is to be noted that the shaft 130 during its return oscillation clockwise does not act upon the metal tape 27 and the shaft surface is withdrawn from contact of its own surface from the sleeves 134 by virtue of the oscillation of 130 about an eccentrical axle. On completion of this clockwise swing of the shaft 130, the members 142 and 143 are hookedly engaged again and their disengagement will take place at the next operative cycle but only if 152 has sensed the run of another sheet 24. This safety interlock prevents strips 23 from being severed from the tape and that they are not applied to the relative sheets as 24, the noxious consequence of such facts being easy to conceive.

Thus, an extremely compact machine has been provided, which is capable of working with an extremely high accuracy and reliability even if the working speed exceeds 120 strokes per minute.

While the invention has been shown and described in connection with a possible embodiment thereof, it will be understood that modifications and changes can be introduced therein without departing from the scope of the invention as defined in and by the appended claims.

I claim:

1. A machine for applying a metal strip to a sheet-material unit, characterized in that it comprises, in combination:

(a) a station for forming said metal strip and applying same to said sheet-material unit;

(b) a feeding unit for feeding said sheet-material unit to said forming station;

(c) a feed source for feeding a metal tape to the forming station in superposed relationship relative to said sheet-material unit;

(d) in said forming station, shaping and applying means adapted to sever said strip from said metal tape and to apply it to said sheet-material unit, (e) first conveyance means adapted to convey the sheet-material unit with the metal strip applied thereto past said shaping and applying means in a direction toward said feed source and to the exterior of the machine;

(f) said forming station is in a position between and generally in line with said feeding unit and said feeding source, so that the units of sheet-material and the metal tape are fed to the station from opposite directions in edge-to-edge approaching relationship that is in counterflow relationship to one another immediately prior to reaching said applying means; and (g) actuation and control means being further provided for controlling the machine.

2. Machine according to claim 1, characterized in that said forming station, said feeding unit and said feeding source lie all on the same longitudinal central axis of the machine.

3. Machine according to claim 1, characterized in that said first conveyance means lie on a plane above the feeding path for said metal tape.

4. Machine according to claim 3, characterized in that said first conveyance means cooperate with second conveyance means perpendicular to such first means and to the directions of feed of both said feeding unit and said feeding source.

5. Machine according to claim 4, characterized in that said first conveyance means comprise a plurality of couples of rollers having parallel axes, said rollers being capable of being approached to and withdraw from one another to pinch therebetween the sheet-material unit in said forming station and conveying belts extended from said couples of rollers to said second conveyance means.

6. Machine according to claim 1, characterized in that said feeding unit for feeding such sheet-material unit comprises a storage magazine for sheet-material units, means for grasping from said magazine one unit at a time and to position it in engagement with third conveyance means which convey it to said forming station.

7. Machine according to claim 6, characterized in that said third conveyance means comprise a plurality of couples of rollers having parallel axes, which can be approached to and spaced apart from one another to pinch the sheet-material unit inserted therebetween by said grasping and positioning means and conveying belts extending from said couples of rollers to the inlet side for said sheet-material unit in said forming station.

8. Machine according to claim 1, characterized in that said feed source for said metal tape comprises a coil of metal tape, a first couple of cylinders for drafting, having parallel axes and adapted to pay off such tape from said coil to pinch it between the cylinders and to feed it in the form of a loose bend between a second couple of drafting cylinders having parallel axes, rotated stepwise and arranged in correspondence with the leading edge of said metal tape towards such forming station, said second couple of drafting cylinders being capable of having respective cylinders approached to and spaced apart from one another with the rotation of said second couple of drafting cylinders being controlled by a sensor which is adapted to sense the presence of a sheet-material unit in said forming station.

9. Machine according to claim 1, characterized in that said shaping and applying means comprise a set of punches and counterpunches adapted to form on the metal tape a plurality of projections for fastening the tape to the sheet-material unit, a movable die and a fixed counterdie adapted to sever from the metal tape a strip having said plurality of projections, and an anvil cooperating with said movable die for applying the metal strip to the sheet-material unit.

10. Machine according to claim 1, characterized in that said forming station cooperates with positioning means adapted to position the sheet-material unit at a preselected position relative to said shaping and applying means.

11. Machine according to claim 10, characterized in that said positioning means are formed by oscillating flaps which are actuated so as to abut the leading and trailing edges of the sheet-material units which are at said forming station.

12. Machine according to claim 1, characterized in that said actuation and control means comprise a set of cams mounted on a mainshaft of the machine, driven by a drive and reducing gear, said cams being connected to the machine component parts to be actuated by the agency of bell-crank levers and clevises.

13. A machine for severing a metal strip from an edge portion of a metal web and applying the metal strip to an edge portion of a sheet-material blank comprising means for feeding a sheet-material blank to a first position in a first plane, means for feeding an edge portion of a metal web to a second position in a second plane with the first and second planes being in spaced though generally parallel relationship with edge portions of the blank and metal web being overlapped while in the respective first and second positions, means for forming staples in the metal web edge portion, means for severing from the metal edge portion a metal strip having the staples therein, and means for moving the metal strip out of said second plane into contact with the blank edge portion generally in said first plane to effect the application of the metal strip to the sheet-material blank edge portion.

14. The machine as defined in claim 13 including an anvil in opposed relationship to the direction of movement of said moving means whereby the staples of the metal strip are embedded in the sheet-material blank edge portion.

15. The machine as defined in claim 14 wherein the metal web feeding means feed the metal web edge portion in a predetermined direction toward said second position, and said severing means being more closely adjacent said second position than said staples forming means and in downstream relationship thereto relative to said predetermined direction of metal web feed.

16. The machine as defined in claim 15 wherein said moving means and said severing means include cooperative movable and fixed dies respectively, said fixed die is disposed between said first and second planes, and said staples forming means include fixed and movable dies disposed on opposite sides of said second plane.

17. The machine as defined in claim 14 wherein said moving means and said severing means include cooperative respective movable and fixed dies.

18. The machine as defined in claim 14 wherein said moving means and said severing means include cooperative movable and fixed dies respectively, and said staples forming means are movable with said movable die.

19. The machine as defined in claim 14 wherein said moving means and said severing means include cooperative movable and fixed dies respectively, said fixed die is disposed between said first and second planes, and said staples forming means include fixed and movable dies disposed on opposite sides of said second plane.

20. The machine as defined in claim 13 wherein the metal web feeding means feed the metal web edge portion in a predetermined direction toward said second position, and said severing means being more closely adjacent said second position than said staples forming means and in downstream relationship thereto relative to said predetermined direction of metal web feed.

21. The machine as defined in claim 20 wherein said moving means and said severing means include cooperative respective movable and fixed dies.

22. The machine as defined in claim 20 wherein said moving means and said severing means include cooperative movable and fixed dies respectively, and said staples forming means are movable with said movable die.

23. The machine as defined in claim 20 wherein said moving means and said severing means include cooperative movable and fixed dies respectively, said fixed die is disposed between said first and second planes, and said staples forming means include fixed and movable dies disposed on opposite sides of said second plane.

24. The machine as defined in claim 13 wherein said moving means and said severing means include cooperative respective movable and fixed dies.

25. The machine as defined in claim 13 wherein said moving means and said severing means include cooperative movable and fixed dies respectively, and said staples forming means are movable with said movable die.

26. The machine as defined in claim 13 wherein said moving means and said severing means include cooperative movable and fixed dies respectively, said fixed die is disposed between said first and second planes, and said staples forming means include fixed and movable dies disposed on opposite sides of said second plane.

27. A machine for severing a metal strip from an edge portion of a metal web and applying the metal strip to an edge portion of a sheet-material blank comprising means for feeding a sheet-material blank in a first direction to a first position in a first plane, means for feeding an edge portion of a metal web in a second direction opposite said first direction to a second position in a second plane with the first and second planes and the respective edge portions therein being in spaced though generally parallel and overlapped relationship, means movable generally normal to said first and second planes for severing from the metal edge portion a metal strip, said severing means including cooperative stationary and movable dies, said stationary die being positioned between said first and second planes, said movable die being normally positioned at a side of said second plane opposite to the position of said stationary die, a stationary anvil opposing the movement of the movable die, said movable die having a surface upon which the metal strip is carried and brought against the blank edge portion while backed-up by said anvil, and means for simultaneously feeding the sheet-material blank with the metal strip applied thereto in said first plane to a third position by movement in a third direction opposite, spaced from, and generally parallel to said second feeding direction and in the same direction as and generally in line with said first feeding direction.

28. The machine as defined in claim 27 including means for forming staples in the metal strip prior to the severance thereof from the metal web edge portion whereby the movable die surface and opposing anvil secure the metal strip to the blank edge portion by forcing the staples therein.

29. The machine as defined in claim 28 wherein said staples forming means include cooperative movable punches and stationary dies, and said movable punches are simultaneously moved during the movement of said movable severing die.

30. The machine as defined in claim 29 wherein said movable punches and stationary dies are up stream of said movable and fixed severing dies relative to said second feeding direction.

31. A machine for severing a metal strip from an edge portion of a metal web and appling the metal strip to an edge portion of a sheet-material blank comprising means for feeding a sheet-material blank in a first direction to a first position in a first plane, means for feeding an edge portion of a metal web in a second direction opposite said first direction to a second position in a second plane with the first and second planes and the respective edge portions therein being in spaced though generally parallel and overlapped relationship, means movable generally normal to said first and second planes for the severing from the metal edge portion a metal strip, said severing means including cooperative stationary and movable dies, said stationary die being positioned between said first and second planes, said movable die being normally positioned at a side of said second plane opposite to the position of said stationary die, a stationary anvil opposing the movement of the movable die, and means for simultaneously feeding the sheet-material blank with the metal strip applied thereto in said first plane to a third position by movement in a third direction opposite, spaced from, and generally parallel to said second feeding direction and in the same direction as and generally in line with said first feeding direction.

32. The machine as defined in claim 31 including means for forming staples in the metal strip prior to the severance thereof from the metal web edge portion whereby the movable die surface and opposing anvil secure the metal strip to the blank edge portion by forcing the staples therein.

33. The machine as defined in claim 32 wherein said staples forming means includes cooperative movable punches and stationary dies, and said movable punches are simultaneously moved during the movement of said movable severing die.

34. The machine as defined in claim 33 wherein said movable punches and stationary dies are upstream of said movable and fixed severing dies relative to said second feeding direction.

35. A machine for forming staples in an edge portion of a metal web from which is severed a metal strip and applying the metal strip to an edge portion of a sheet material blank by embedding the staples of the metal strip into the blank edge portion comprising means for forming staples along an edge portion of a metal web, means for moving a movable severing die generally normal to the metal web for severing from the metal web a metal strip including the staples, an anvil in opposed relationship to the direction of movement of the severing die, means for positioning an edge portion of a sheet material blank in the path of movement of said severing die and said anvil, and said moving means move said severing die a distance sufficient to cause the staples to become embedded in the blank edge portion during the back-up of the latter by said anvil.

36. The machine as defined in claim 35 wherein said staple forming means is operative to form staples in the metal web before the severance of the metal strip and during the movement of the severing die toward said anvil.

37. The machine as defined in claim 36 wherein said staple forming means include a movable punch and an opposing punch die, a stationary severing die cooperative with said movable severing die to sever the metal strip, and means for effecting the severance of the metal strip by the cooperative movable and stationary severing dies after the formation of staples by the cooperative movable punch and opposing punch die.

38. The machine as defined in claim 35 wherein said staple forming means include a movable punch and an opposing punch die, a stationary severing die cooperative with said movable severing die to sever the metal strip, and means for effecting the severance of the metal strip by the cooperative movable and stationary severing dies after the formation of staples by the cooperative movable punch and opposing punch die.

39. The machine as defined in claim 38 wherein said last-mentioned means includes a common carrier for said movable severance die and said movable punch.

40. The machine as defined in claim 38 wherein said stationary severing die and punch die are defined by a common element.

41. The machine as defined in claim 38 wherein said movable severing die moves generally vertically upwardly during the severing of the metal strip, and said movable severing die includes an uppermost surface for supporting the severed metal strip and carrying the same toward and against the blank edge portion.

42. A method of forming staples in an edge portion of a metal web from which is severed a metal strip and applying the metal strip to an edge portion of a sheet-material blank by embedding the staples of the metal strip into the blank edge portion comprising the steps of positioning an edge portion of a sheet-material blank in superposed overlapped relationship to an edge portion of a metallic web, maintaining the sheet-material blank and the metallic web in generally parallel though spaced apart planes with the edge portions of the sheet-material blank and the metal web in spaced overlapped relationship, forming staples in the metal web edge portion by applying a force thereto in a direction toward and generally normal to the plane of the metal web and the plane of the sheet-material blank, severing the edge portion with the staples therein to form a metal strip, again by the application of a severing force generally normal to and in a direction toward the planes of the metal web and the sheet-material blank, conveying the metal strip toward and against the sheet-material blank edge portion by movement generally normal to the plane of the sheet-material blank, and forcefully embedding the staples of the metal strip into the edge portion of the sheet-material blank.

43. The method as defined in claim 42 including the steps of bringing the edge portion of the sheet metal blank in superposed overlap relationship to the edge portion of the metallic web by moving the sheet metal blank and the metallic web along two paths of travel in substantially opposed relationship to each other, and after embedding the staples of the metal strip into the edge portion of the sheet-material blank moving the sheet material blank and the metal strip stapled thereto along a third path of travel in the same direction of movement as that of the movement of the sheet-material blank and in spaced parallel relationship to the movement of the metallic web but in opposed relationship to the direction of movement thereof.

* * * * *